US008607494B2

(12) United States Patent
Shipman et al.

(10) Patent No.: US 8,607,494 B2
(45) Date of Patent: Dec. 17, 2013

(54) FIREARM PULL-THROUGH CLEANING TOOL WITH INTEGRATED FOLDABLE HANDLE

(75) Inventors: Kel Shipman, Rochester, NY (US); Steven C. Buxton, Turin, NY (US)

(73) Assignee: The Otis Patent Trust, Lyons Falls, NY (US)

( * ) Notice: Subject to any disclaimer, the term of this patent is extended or adjusted under 35 U.S.C. 154(b) by 0 days.

(21) Appl. No.: 13/448,973

(22) Filed: Apr. 17, 2012

(65) Prior Publication Data

US 2012/0291803 A1 Nov. 22, 2012

Related U.S. Application Data

(60) Provisional application No. 61/488,539, filed on May 20, 2011.

(51) Int. Cl.
*F41A 29/00* (2006.01)

(52) U.S. Cl.
USPC ..... 42/95; 15/104.05

(58) Field of Classification Search
USPC ..... 42/95, 90; 15/104.011, 104.05, 211
See application file for complete search history.

(56) References Cited

U.S. PATENT DOCUMENTS

| | | | | |
|---|---|---|---|---|
| 4,716,673 | A | 1/1988 | Williams et al. | |
| 5,171,925 | A | 12/1992 | Mekler | |
| 5,588,242 | A | 12/1996 | Hughes | |
| 5,871,589 | A | 2/1999 | Hedge | |
| 5,972,125 | A | 10/1999 | Hedge | |
| 6,145,235 | A * | 11/2000 | Emerson et al. | 42/90 |
| 6,630,034 | B1 | 10/2003 | Schnell | |
| 2005/0229467 | A1 * | 10/2005 | Sohn | 42/95 |
| 2013/0091753 | A1 * | 4/2013 | Rogers et al. | 42/95 |

* cited by examiner

*Primary Examiner* — J. Woodow Eldred
(74) *Attorney, Agent, or Firm* — Harris Beach PLLC

(57) ABSTRACT

A novel firearm pull-through cleaning tool with an integrated foldable handle. The handle is pivotable at a first tool end between a closed position wherein a portion of the handle occupies a longitudinal well in the tool body and an open position wherein the handle is substantially transverse to the longitudinal axis of body. When in closed position the diameter of the tool is less than the bore diameter of a weapon to be cleaned. In use, the handle is pivoted in a first direction to place the tool in the closed position; the tool is inserted into the firearm bore; a cleaning tool is attached to the attachment portion; the tool is passed through the bore; the handle is pivoted in a second direction to place said tool in the open position; and the handle is pulled to cause the cleaning tool to be passed through the bore.

5 Claims, 2 Drawing Sheets

FIREARM PULL-THROUGH CLEANING TOOL WITH INTEGRATED FOLDABLE HANDLE

CROSS REFERENCE TO RELATED APPLICATION

Reference is made to and this application claims priority from and the benefit of a U.S. Provisional Application Ser. No. 61/488,539, filed May 20, 2011, entitled "Bolt and Bolt Carrier Cleaning System and Tools With Integrated Pull-through Handle, which application is incorporated herein in its entirety by reference.

FIELD OF THE INVENTION

This disclosure relates generally to tools for cleaning components of firearms such as M4, M16, and other similarly small-caliber rifles and carbines, for example and, more specifically, to a firearm cleaning tool having a foldable T-handle, also referred to interchangeably herein as a "pull-through handle tool", a "tool", or a "foldable tool", formed for passage in folded configuration through the bore of a weapon.

BACKGROUND OF THE INVENTION

Carbon and other residue from gunpowder and from firearm discharge reactions accumulate on the walls of the firing chamber and barrel bore of a weapon over time, with deleterious effects on cleanliness, performance, and longevity of the firearm. Cleaning such residues typically requires disassembly of the weapon to access and clean these surfaces. The firing chamber may be cleaned with a specially-shaped metal brush and/or scraper, and the bore may be cleaned by passing a cloth swab or soft-bristled brush therethrough one or more times. A number of specialized tools, such a cleaning rods and cables, have been introduced to assist in cleaning a firing chamber and bore, but have had substantial shortcomings.

SUMMARY OF THE INVENTION

Although a cleaning rod can be useful and may be advantageous for certain bore-cleaning applications, it suffers from drawbacks. One drawback is that it is rigid and therefore ungainly to carry in the field, especially when it comprises a rigidly transverse T-handle. Another drawback is that a cleaning rod is easily bent or broken. Another drawback is that a cleaning rod or cable having an integral T-handle may be inserted into a weapon's bore from only the muzzle end in certain weapons.

In accordance with one aspect of the disclosure, a foldable T-handle tool is provided that can fit through the barrel of a small-bore weapon, e.g., a .223 caliber rifle, in either direction.

In accordance with another aspect of the disclosure, one or more components of such a foldable T-handle tool is threaded to permit attachment of any of a variety of other tools to assist in cleaning a weapon.

BRIEF DESCRIPTION OF THE DRAWINGS

The features described herein can be better understood with reference to the drawings described below. The drawings are not necessarily to scale, emphasis instead generally being placed upon illustrating the principles of the invention. In the drawings, like numerals are used to indicate like parts throughout the various views, wherein.

DETAILED DESCRIPTION OF THE INVENTION

Figure 1:
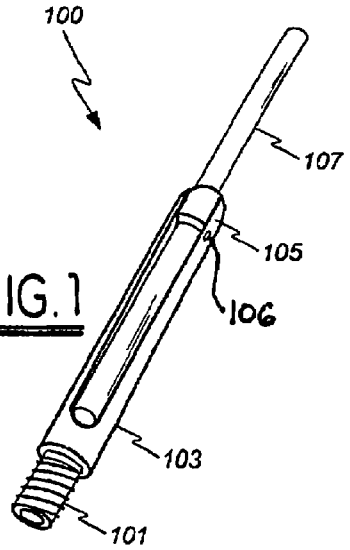
FIG. 1 depicts a perspective view of an illustrative embodiment of a pull-through foldable handle tool in a closed position.
Figure 2:
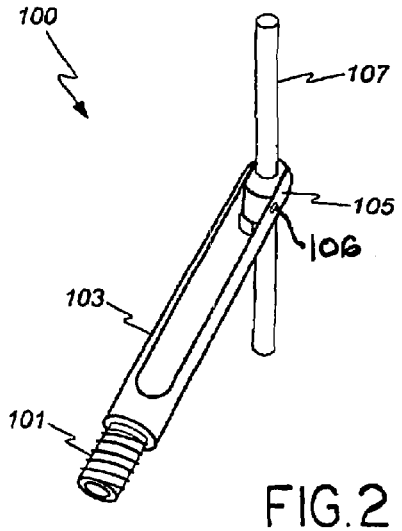
FIG. 2 depicts a perspective view of an illustrative embodiment of a pull-through foldable handle tool in an open position.
Figure 3:
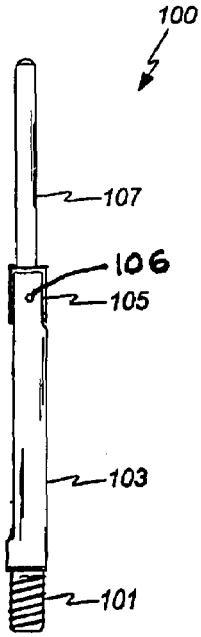
FIG. 3 depicts a side plan view of the embodiment shown in FIG. 1.
Figure 4:
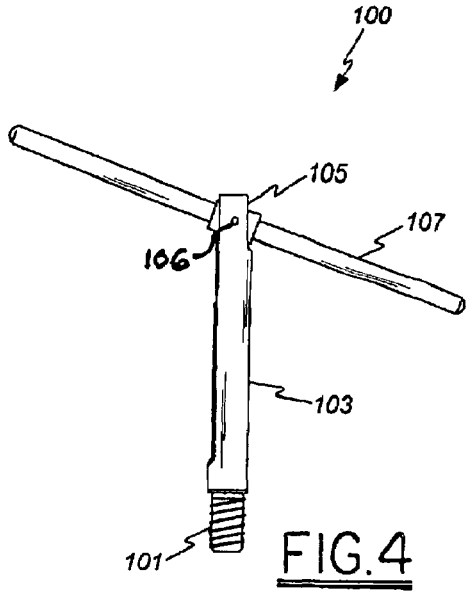
FIG. 4 depicts a side plan view of the embodiment shown in FIG. 2.
Figure 5:
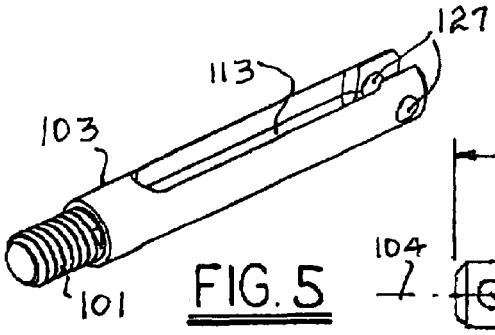
FIG. 5 depicts a perspective view of a body portion of the tool shown in FIGS. 1 through 4.
Figure 6:
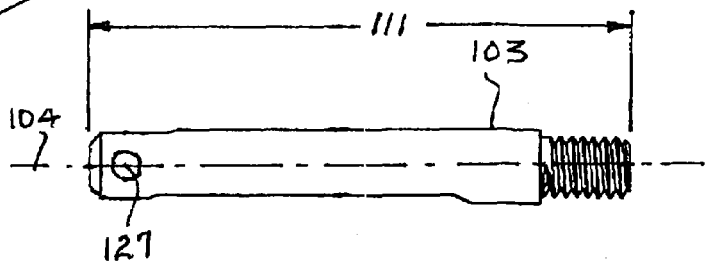
FIG. 6 depicts a first side plan view of the body portion shown in FIG. 5.
Figure 7:
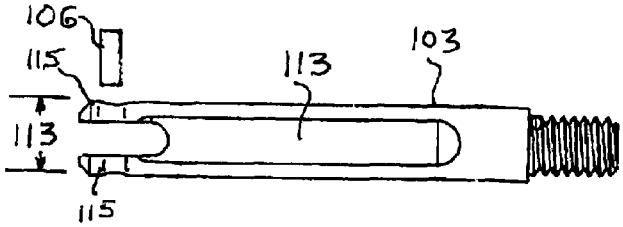
FIG. 7 depicts a second side plan view of the body portion shown in FIG. 5.
Figure 10:
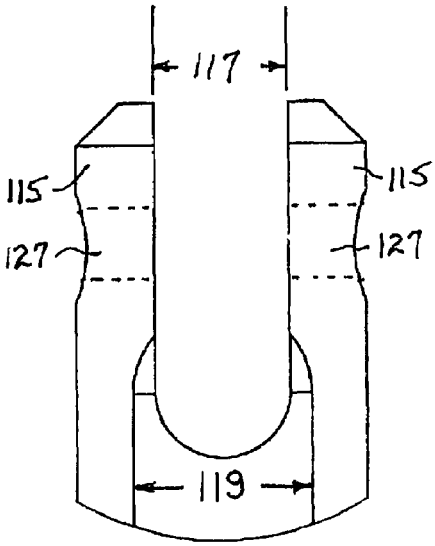
FIG. 10 depicts a detailed plan view of a portion of the view shown in FIG. 7.
Figure 8:
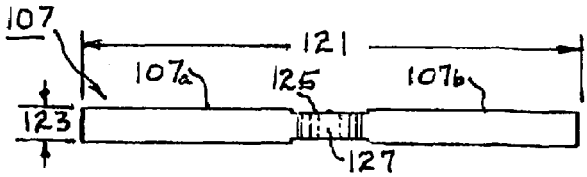
FIG. 8 depicts a first side plan view of a handle of the embodiment shown in FIGS. 1 through 4.
Figure 9:
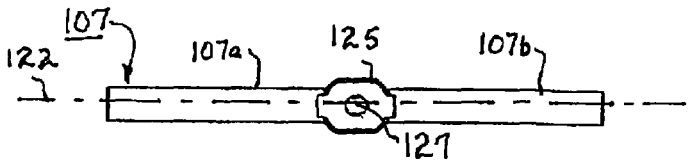
FIG. 9 depicts a second side plan view of a handle of the embodiment shown in FIGS. 1 through 4.

FIGS. 1-4 depict various views of a first illustrative embodiment of a foldable pull-through tool 100. FIG. 1 shows a perspective view of tool 100 in a closed position; FIG. 2 shows a perspective view of tool 100 in an open position; FIG. 3 depicts a side plan view of tool 100 in a closed position; and FIG. 4 depicts a side plan view of tool 100 in an open position.

Tool 100 has dimensions such that, in the closed position, as shown in FIGS. 1 and 3, tool 100 may fit through the bore of a small caliber firearm, such as an M4 carbine (not shown), in an illustrative embodiment. Some firearms such as those chambered for 0.223 inch (5.56 mm) ammunition have a small bore that makes it difficult to make a foldable T-handle tool that can pass through the bore yet still be strong enough to pull tight cleaning materials through the bore. Consequently, prior art methods for cleaning small bores require either attaching a T-handle tool, either rigid or foldable, to a cleaning rod or cable previously passed through the bore, or not using a T-handle tool at all. Other embodiments in accordance with the present invention may be sized to fit through the bores of any of a wide variety of types and calibers of firearms up to at least about .30 caliber. Preferably, the outer diameter of the T-handle tool is only slightly less than the caliber or bore of the weapon to be cleaned.

Pull-through handle tool 100 has a body 103, a threaded attachment portion 101, e.g., an 8-32 thread, formed at one end of body 103, a swivel assembly 105 disposed at an opposite end of body 103, and a handle 107 pivotably attached to body 103 in swivel assembly 105 by a roll pin 106 extending through both body 103 and handle 107. Any of a wide variety of cleaning tools or other attachments (not shown herein but well known in the weapon-cleaning arts) may be attached to pull-through handle tool 100 by being screwed onto threaded attachment portion 101.

Because of its dimensions, when tool 100 is in the closed position as in FIGS. 1 and 3, tool 100 may be dropped into a firearm bore from the breech or muzzle end and passed toward the opposite end of the bore, with any attachment following it through the bore.

Once tool 100 emerges from the bore, a user may unfold the handle 107 into the open position as shown in FIGS. 2 and 4, enabling the user to pull on handle 107 with significant force as needed, preferably up to at least 100 pounds. For example, a flexible cable may be attached to threaded attachment portion 101 with a cleaning implement, such as a brush, attached on the other end of the flexible cable. The cleaning implement may exert significant frictional forces against the interior of the bore, such that it may be advantageous to the cleaning process to be able to draw the cleaning implement through the bore with significant force, which is made possible with tool 100.

Tool 100 also has the advantage of being attached to the flexible cable and cleaning implement throughout the process of pulling the combined assemblage of tool 100, cable, and cleaning implement through the barrel, so that the combined assemblage can be stored together in a completely attached state beforehand, remain in a completely attached state during the cleaning process, and be stowed again still in the completely attached state once the user is finished performing the cleaning process. This provides a significant advantage over some other prior art systems wherein a cable is dropped through a bore and a lone T-handle attachment is attached to the cable only after the cable emerges through the muzzle, or no handle is used at all which diminishes the effective pulling force capability. Tool 100, by being able to be stored, used, and stowed again while remaining attached to the rest of the assemblage throughout the process, eliminates the need for the user to manipulate a lone handle portion and to have to go through the process of attaching a lone handle portion to a cable during the middle of the cleaning process. A lone handle portion on its own is relatively small, and the process of attaching it to a cable in the middle of a cleaning process may require some degree of concentration and care, which may be difficult in a field operations setting. Tool 100, by being able to be stored, used, and stowed again while remaining attached to the rest of the assemblage throughout the process, may make the cleaning process as easy and simple as possible, which can make the difference between success and failure for a cleaning process in a field operations setting, especially under military conditions.

Referring now to FIGS. 5 through 10, the individual components of tool 100 are shown in greater detail. The exemplary dimensions shown permit this embodiment of a tool in accordance with the present invention to be passed easily in folded configuration through the bore of a .223 caliber weapon. All dimensions may be scaled up or down as may be desired when providing an analogous tool for cleaning a larger or smaller bore weapon.

Body 103 is preferably formed of brass or other alloy or combination of suitable materials that are both strong enough and provide protection to the barrel, has a longitudinal axis 104, has an overall length 111 of about 1.50 inches, and has an outside diameter 113 of about 0.203 inch. Body 103 is provided with a longitudinal well 113 opening onto the outside of the tool body for receiving a portion of handle 107 when tool 100 is in folded configuration, such that the diameter of handle 107 is contained within the diametric envelope of body 103. Well 113 preferably has a width 119 of about 0.125 inch and a resulting wall thickness of about 0.039 inch. Well 113 is extended in a narrowed portion through an end of body 103 both longitudinally and transversely, thereby forming first and second parallel ears 115 as components of swivel assembly 105. Preferably, ears 115 are spaced apart 117 by about 0.094 inch, resulting in an ear thickness of about 0.055 inch.

Pivotable handle 107 is preferably formed of brass and comprises first and second cylindrical handle portions 107*a*, 107*b* for manual gripping of tool 100, and a central portion 125 between the handle portions. Pivotable handle 107 has an overall length 121 of about 1.80 inches, a cylindrical handle diameter of about 0.125 inch, and a longitudinal axis 122. Central portion 125 has a thickness of about 0.094 inch, enabling it to fit snugly and yet pivot freely, yet with appropriate friction, between ears 115. The friction is controlled by the tolerence between opening 117 and the thickness of 125. This allows the user to close the tool and trust that it will stay closed until the user is ready to engage the T-handle. Central portion 125 and ears 115 are provided with alignable bores 127 for receiving steel roll pin 129 to form swivel assembly 105. The roll pin may be a solid pin or roll pin or small shoulder screw. Note that ears 115 are thicker than the walls of well 113, providing increased material thickness for receiving roll pin 129 and therefore increased strength in swivel assembly 105 over any other configuration wherein analogous well is not narrowed in passing between the ears and the thickness of the ears is the same as the thickness of the well walls. Preferably, tool 100 is capable of sustaining a pull force on handle 107 of at least 100 pounds against an opposing drag on body 103.

A sample of devices and methods that are described herein is as follows:

A tool comprising a longitudinal body having first and second spaced-apart ears at a first end thereof, an attachment portion at a second and opposite end thereof, and a longitudinal well terminating at the spaced-apart ears; a handle disposed on a pivot pin between the first and second ears, wherein the handle is rotatable on the pivot pin between a closed position wherein a portion of the handle occupies the longitudinal well and an open position wherein the longitudinal axis of the handle is substantially transverse to the longitudinal axis of the body.

The outer diameter of the tool when in the closed position is less than the bore diameter of a weapon to be cleaned, e.g., about .30 caliber (inch) or less.

The thickness of each of the first and second ears is greater than the thickness of the wall of the longitudinal well.

The tool can withstand a pull force on the handle of at least about 100 pounds when opposed by a like drag force on the longitudinal body.

While the present invention has been described with reference to a number of specific embodiments, it will be understood that the true spirit and scope of the invention should be determined only with respect to claims that can be supported by the present specification. Further, while in numerous cases herein wherein systems and apparatuses and methods are described as having a certain number of elements it will be understood that such systems, apparatuses and methods can be practiced with fewer than the mentioned certain number of elements. Also, while a number of particular embodiments have been described, it will be understood that features and aspects that have been described with reference to each particular embodiment can be used with each remaining particularly described embodiment.

What is claimed is:

1. A collapsible T-handle for use in cleaning the barrel of a firearm having a bore of a fixed internal diameter, said collapsible T-handle comprising:

a longitudinal body having first and second spaced-apart ears at a first end thereof, an attachment portion at a second and opposite end thereof, and a longitudinal well terminating at said spaced-apart ears; and a handle disposed on a pivot pin between said first and second ears;

wherein said handle is rotatable on said pivot pin between a closed position wherein a portion of said handle occupies said longitudinal well and an open position wherein the longitudinal axis of said handle is substantially transverse to the longitudinal axis of said body; and wherein the outer diameter of said T-handle when in said closed position is less than the bore diameter of the firearm to be cleaned.

2. The collapsible T-handle of claim 1 wherein the thickness of each of said first and second ears is greater than the thickness of a wall of said longitudinal well.

3. The collapsible T-handle of claim 1 wherein said tool can withstand without failure a pull force on said handle of at least about 100 pounds when opposed by a like drag force on said longitudinal body.

4. The collapsible T-handle of claim 1 wherein the maximum overall outside diameter is less than about 0.30 inch.

5. A method for cleaning the bore of a firearm, comprising the steps of:

providing a tool having a longitudinal body having first and second spaced-apart ears at a first end thereof, an attachment portion at a second and opposite end thereof, and a longitudinal well terminating at said spaced-apart ears, and a handle disposed on a pivot pin between said first and second ears, wherein said handle is rotatable on said pivot pin between a closed position wherein a portion of said handle occupies said longitudinal well and an open position wherein the longitudinal axis of said handle is substantially transverse to the longitudinal axis of said body;

pivoting said handle in a first direction to place said tool in said closed position;

inserting said tool in said closed position into said firearm bore;

attaching a cleaning tool to said attachment portion;

passing said tool through said bore;

pivoting said handle in a second direction to place said tool in said open position; and pulling on said handle to cause said cleaning tool to be passed through said bore.

* * * * *